US005359167A

United States Patent [19]

Demissy et al.

[11] Patent Number: 5,359,167

[45] Date of Patent: Oct. 25, 1994

[54] WHIP FOR A HIGH TENSION SECTION SWITCH

[75] Inventors: Daniel Demissy, Montreal; Jean-Guy Chevaliere, Anjou; Hadj Alidou; Anh Dung Huynh, both of Montreal, all of Canada

[73] Assignee: GEC Alsthom Energie Inc., La Praire, Canada

[21] Appl. No.: 57,860

[22] Filed: May 7, 1993

[30] Foreign Application Priority Data

May 11, 1992 [FR] France ..... 92 05692

[51] Int. Cl.[5] ..... H01H 31/00

[52] U.S. Cl. ..... 200/48 R; 200/275; 200/48 V; 200/485 B; 200/48 CB

[58] Field of Search ..... 200/48 R, 48 A, 48 KB, 200/48 V, 48 SB, 48 CB, 275

[56] References Cited

U.S. PATENT DOCUMENTS

| | | | |
|---|---|---|---|
| 2,831,931 | 4/1958 | Kelly . | |
| 2,953,655 | 9/1960 | Warner, Jr. et al. | 200/48 SB |
| 3,032,632 | 5/1962 | Beach et al. | 200/485 SB X |
| 3,217,115 | 11/1965 | Kaplan | 200/48 R |
| 3,230,324 | 1/1966 | Johnson | 200/48 CB |
| 3,244,825 | 4/1966 | Killian et al. | 200/48 CB |
| 4,243,854 | 1/1981 | Pahl . | |
| 4,661,662 | 4/1987 | Finke et al. | 200/48 R |

FOREIGN PATENT DOCUMENTS

| | | | |
|---|---|---|---|
| 1171067 | 5/1964 | Fed. Rep. of Germany | 200/48 R |

*Primary Examiner*—Ernest G. Cusick

*Attorney, Agent, or Firm*—Sughrue, Mion, Zinn, Macpeak & Seas

[57] ABSTRACT

A whip usable in a high tension section switch, in particular a vertically-opening switch, the whip comprising a flexible metal rod whose section is a truncated circle whose area diminishes progressively from the base of the whip to its tip.

5 Claims, 3 Drawing Sheets

WHIP FOR A HIGH TENSION SECTION SWITCH

The present invention relates to a current-maintaining whip for use in particular in a high tension section switch, in particular a vertically-opening section switch.

BACKGROUND OF THE INVENTION

It is known that high tension section switches must possess a degree of interrupting power, in particular to enable them to break inductive and capacitive currents induced in a length of line being grounded by the proximity of another line that is parallel and under load.

To do this, it is known on separation of the main contacts to divert the current to a flexible conductor element called a "whip", which is secured to the drive arm carrying the moving contact of the section switch and which is constrained to remain in contact with a fixed point that is mechanically and electrically connected to the fixed contact of the section switch until said contacts have been moved apart through a sufficient distance. Thereafter, the whip which has become more and more curved as the contacts move apart, is released and straightens out suddenly, thereby interrupting the current without any risk of restriking.

It is known, in particular from U.S. Pat. Nos. 2,831,931 and 4,243,854 to provide a whip constituted by a tubular metal element of circular section that tapers, from a base connected to the moving contact, towards a free end which is adjacent to the above-mentioned fixed point.

It has been observed that this type of whip is subject to rapid wear.

An object of the present invention is to define a whip of larger section in the electrical contact region while still retaining good flexibility.

Another object of the invention is to provide a whip having greater lateral stiffness than the whips known in the art.

Another object of the invention is to provide a whip that is of cheaper construction than prior art whips.

SUMMARY OF THE INVENTION

These objects are achieved by the whip of the invention which is suitable for use in a high tension section switch, in particular a vertically-opening switch, the whip comprising a flexible metal rod whose section is a truncated circle of area that diminishes progressively from the base to the tip of the whip.

In the electrical contact region, the section of the whip lies in the range 80% to 50% of the section at the base of the whip.

BRIEF DESCRIPTION OF THE DRAWINGS

The invention will be well understood from the embodiment described below with reference to the accompanying drawings, in which.

MORE DETAILED DESCRIPTION

Figure 1:
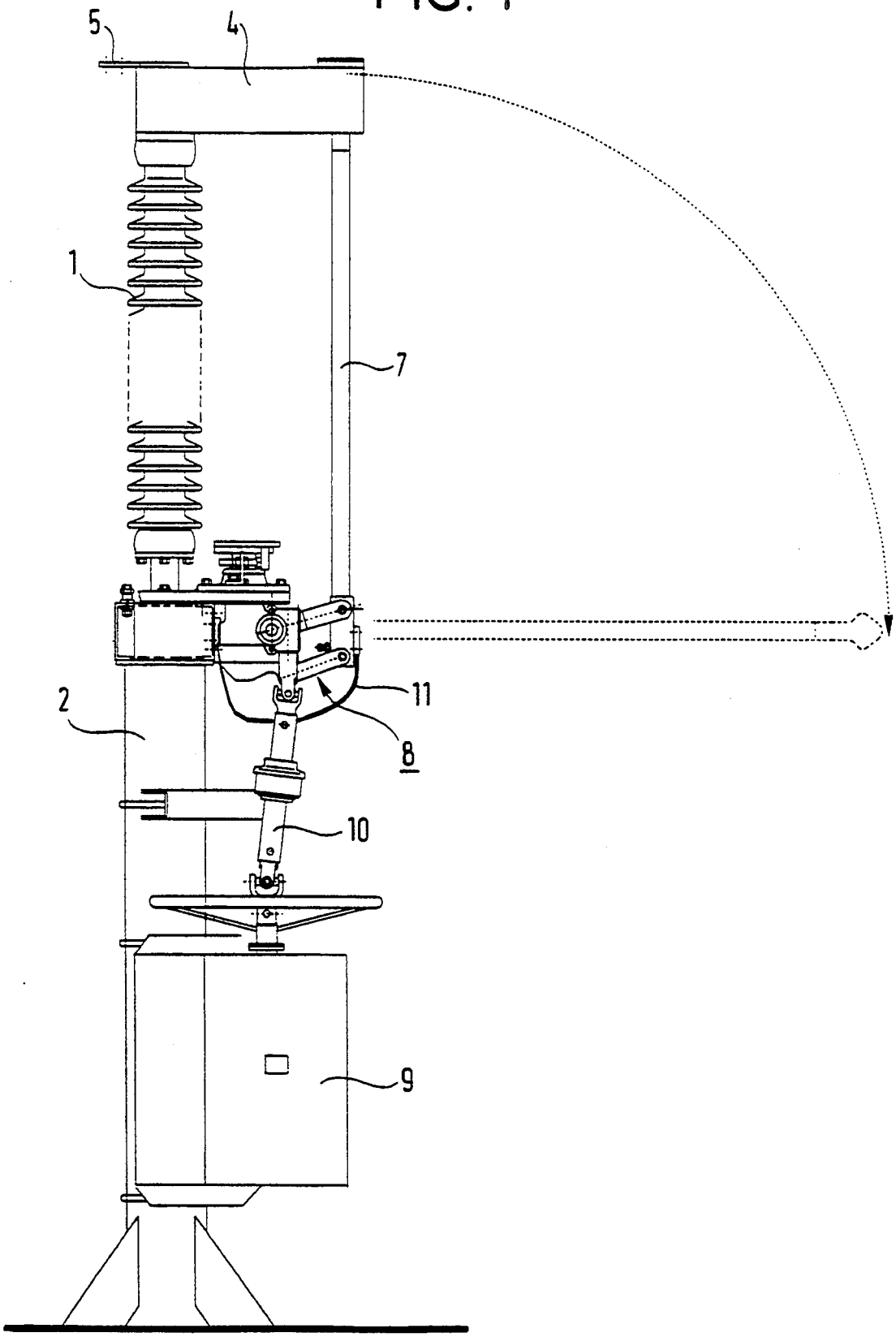
FIG. 1 is an elevation view of a vertically-opening high tension section switch provided with a whip, and shown in the closed position.
Figure 2:
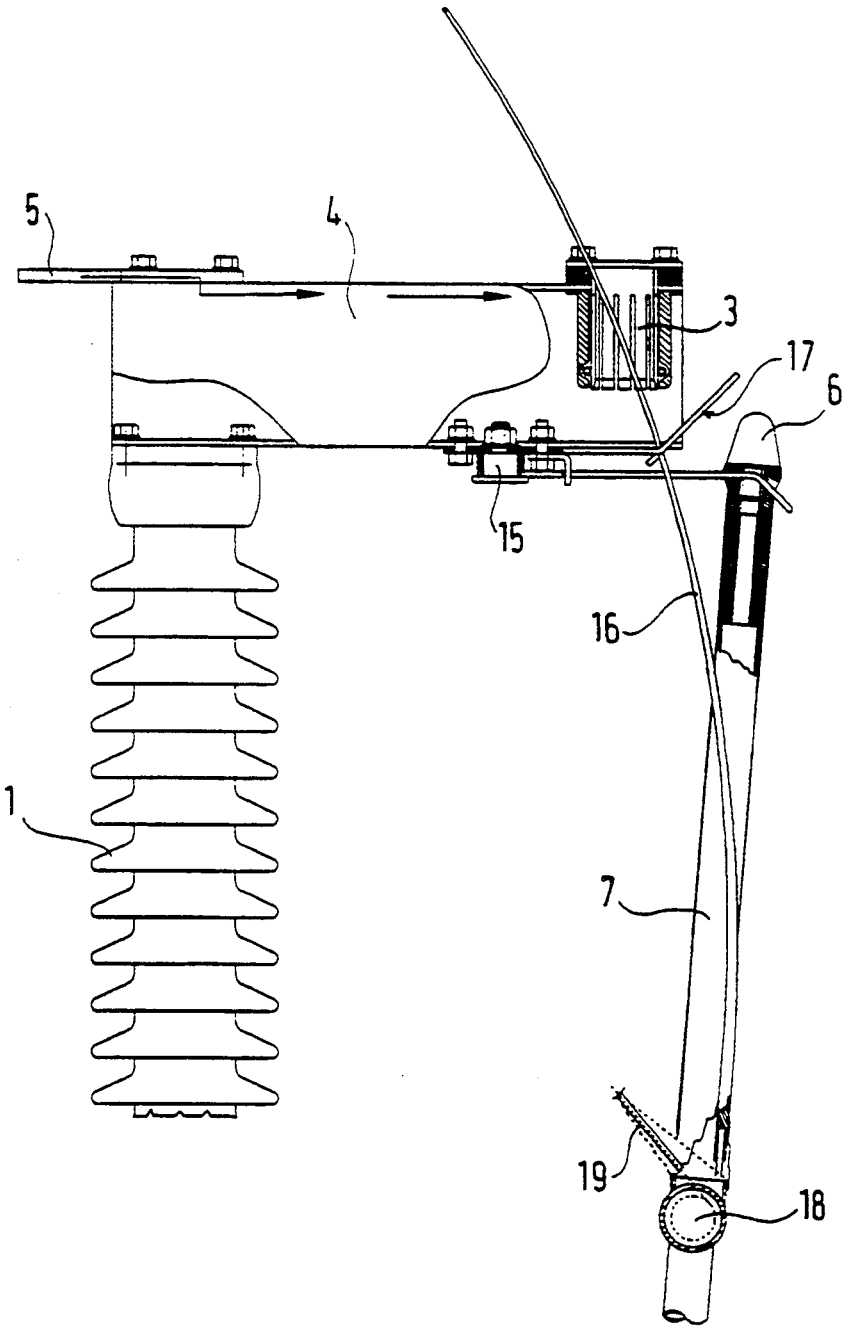
FIG. 2 is a fragmentary view of the same section switch during an opening operation.

FIGS. 1 and 2 show a high tension section switch comprising an insulating column 1 placed on a metal stand 2. A female contact 3 in the form of a thimble of contact fingers is fixed at the end of a metal support 4 placed at the end of the column 1 and carrying a current terminal 5. A male contact 6 is fixed to the end of a drive arm 7 associated with a drive mechanism 8 actuated by a motor contained in a box 9 and which drives a transmission arm 10. The mechanism is organized so that during a section switch opening operation, it initially communicates translation motion to the drive arm 7 along its own axis in order to enable the contacts 3 and 6 to be separated, after which it transmits rotary motion in a vertical plane enabling the arm to take up a position at 90° to its initial position, as shown in dotted lines in FIG. 1. With a Grounding section switch, a metal braid 11 connects the arm 7 to the stand 2 which is grounded.

The section switch is provided with a whip 16 which is fixed to a fixed point 18 of the arm 7 and which is constrained during an opening operation to remain in electrical contact with a part that is mechanically secured to the female contact and that is electrically connected thereto. This is achieved by means of a guide part 17 fixed to the support 5 by bolts 15. A part 19 limits the angle between the whip 7 and the arm 15 while the section switch is in its opening stage.

Figure 3:
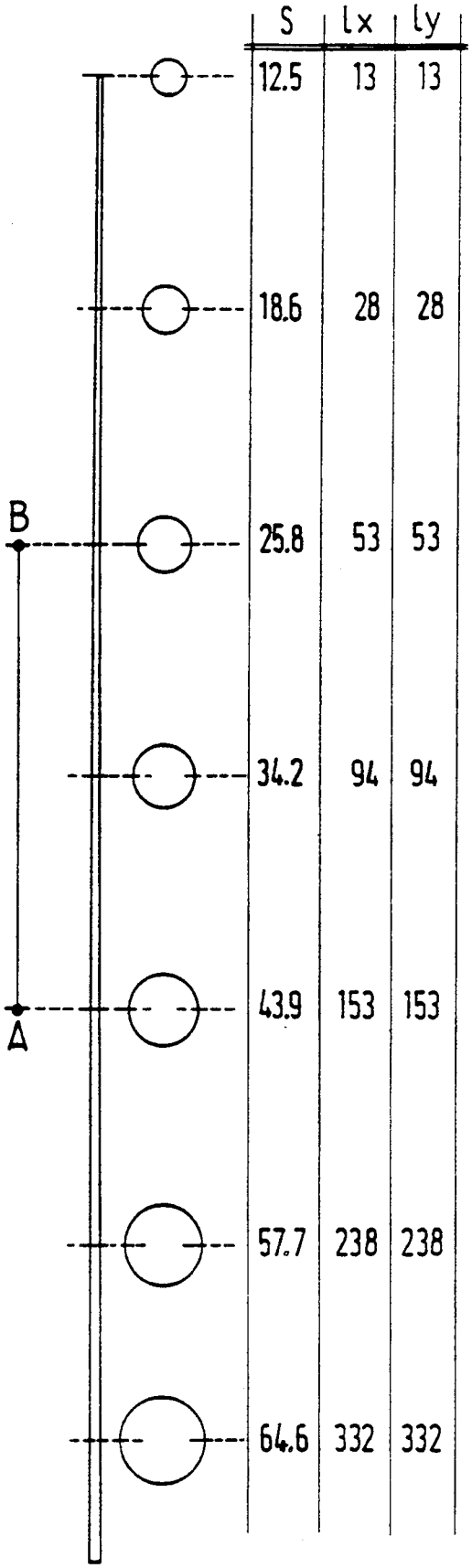
FIG. 3 is a view of a prior art conical whip, with a plurality of successive sections being shown.

FIG. 3 shows a prior art whip, which is circular in section, and which tapers progressively from its base to its end. Seven uniformly spaced apart sections are shown together with their associated surface areas (X) in $mm^2$. The segment AB represents the electrical contact region of the whip.

Figure 4:
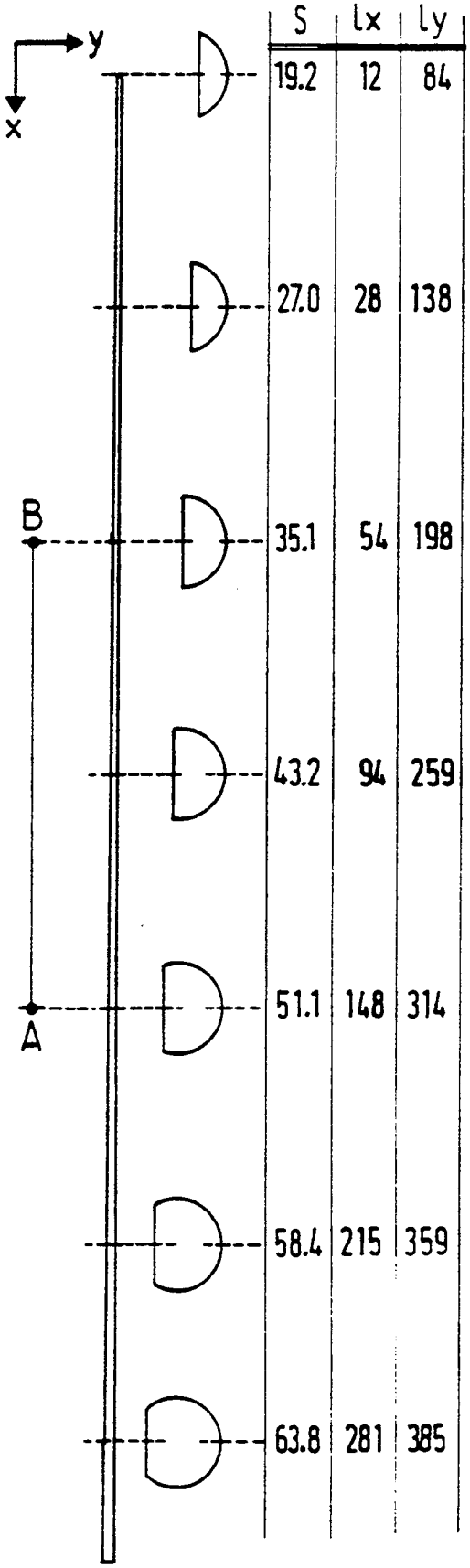
FIG. 4 is a view of a whip of the invention, showing the same sections.

FIG. 4 shows a whip of the invention, and the same sections are shown together with their surface areas in $mm^2$. The sections are truncated circles, i.e. circles having corresponding portions removed therefrom as delimited by a rectilinear secant: the whip thus has a surface that is plane.

It can be seen from the figures that in the electrical contact region AB, the cross-sectional area of the prior art whip lies in the range 67% to 40% of the cross-sectional area of the base of the whip, whereas in the same contact region, the cross-sectional area of the whip of the invention lies in the range 80% to 55% of its base area.

Because of this disposition, the cross-sectional area of the whip in the electrical contact region is about 16% to 36% greater than the cross-sectional area of the conical whip in the same region. This imparts greater capacity for transferring electrical current. Electrostatic induction test measurements have shown that the interrupting power of the whip of the invention is much greater than that of a prior art whip, such that for equal currents, the whip of the invention is subjected to reduced wear, and consequently benefits from increased lifetime.

FIGS. 3 and 4 also show both for the prior art whip and for the whip of the invention, the moments of inertia lx and ly expressed in $mm^4$, where x and y designate two perpendicular directions in a cross-section, with x being parallel to the above-mentioned secant. It is observed on reading these figures that the whip of the invention has greater lateral stiffness than the conventional conically-shaped whip and this gives rise to lateral movements that are restricted.

The whip of the invention can be machined on conventional machine tools more cheaply than can the conically-shaped prior art whip. For example it can be machined by means of a conventional milling machine instead of using a complicated machine. As a result the cost price can be divided by a factor of as much as 4.

The invention is applicable to fitting out high tension section switches, in particular vertically-opening section switches, i.e. switches in which the operating arm moves in a vertical plane.

We claim:

1. A whip for use in a high tension section switch, the whip comprising a flexible metal rod having a base and a tip and an electrical contact portion between said base and said tip, and wherein said rod has a cross-section defining a truncated circle whose area diminishes progressively from said base to said tip.

2. A whip according to claim 1, wherein the cross-sectional area of the whip in said electrical contact portion lies in the range of 80% to 50% of the cross-sectional area at said base.

3. A whip according to claim 1, wherein said high tension section switch comprises a vertically-opening switch.

4. A whip according to claim 2, wherein said high tension section switch comprises a vertically-opening switch.

5. A whip in combination with a vertically-opening, high tension section switch, said whip comprising a flexible metal rod having a base and a tip and an electrical contact portion between said base and said tip, and wherein said rod has a cross section defining a truncated circle whose area diminishes progressively from said base to said tip.

* * * * *

UNITED STATES PATENT AND TRADEMARK OFFICE

CERTIFICATE OF CORRECTION

PATENT NO. : 5,359,167
DATED : October 25, 1994
INVENTOR(S) : Daniel Demissy et al.

It is certified that error appears in the above-indentified patent and that said Letters Patent is hereby corrected as shown below:

On the Title page, item [75], Inventors, change "Chevaliere" to --Chevalier--.

Signed and Sealed this

Twenty-eight Day of February, 1995

*Attest:*

Bruce Lehman

BRUCE LEHMAN

*Attesting Officer*

*Commissioner of Patents and Trademarks*